US005287584A

United States Patent [19]

Skinner

[11] Patent Number: 5,287,584

[45] Date of Patent: Feb. 22, 1994

[54] TOOTHBRUSH

[75] Inventor: John R. Skinner, West Vancouver, Canada

[73] Assignee: Practical Products Ltd., North Vancouver, Canada

[21] Appl. No.: 902,980

[22] Filed: Jun. 23, 1992

[51] Int. Cl.[5] ..... A46B 9/04

[52] U.S. Cl. ..... 15/167.1; 15/227; 2/21

[58] Field of Search ..... 15/110, 167.1, 227; 2/21

[56] References Cited

U.S. PATENT DOCUMENTS

| | | | |
|---|---|---|---|
| D. 97,360 | 10/1935 | Stevens . | |
| 942,003 | 11/1909 | Marsh | 15/227 |
| 2,155,245 | 4/1939 | Sekine . | |
| 2,379,624 | 7/1945 | Chisnell | 2/21 |
| 2,396,548 | 3/1946 | Allen . | |
| 2,439,056 | 4/1948 | Rathbun . | |
| 2,915,767 | 12/1959 | Vaughan . | |
| 2,921,590 | 1/1960 | Holton . | |
| 3,105,260 | 10/1963 | Smith et al. . | |
| 3,505,700 | 4/1970 | Rodriguez | 15/227 |
| 3,798,698 | 3/1974 | Conklin, Jr. | 15/227 |
| 3,905,113 | 9/1975 | Jacob . | |
| 4,251,897 | 2/1981 | Alam . | |
| 4,292,705 | 10/1981 | Stouffer . | |
| 4,617,694 | 10/1986 | Bori . | |
| 4,628,949 | 12/1986 | Mas et al. | 15/227 |

FOREIGN PATENT DOCUMENTS

| | | | |
|---|---|---|---|
| 252710 | 1/1988 | European Pat. Off. | 15/227 |
| 966559 | 3/1950 | France | 15/227 |
| 76319 | 8/1961 | France | 15/227 |
| 2591082 | 6/1987 | France | 15/227 |
| 398919 | 9/1933 | United Kingdom | 15/227 |
| 501791 | 3/1939 | United Kingdom | 15/227 |

*Primary Examiner*—Harvey C. Hornsby
*Assistant Examiner*—Mark Spisich
*Attorney, Agent, or Firm*—Barrigar & Oyen

[57] ABSTRACT

This invention relates to a novel finger toothbrush. More particularly, this invention pertains to a unique toothbrush which can fit on a finger of a user for brushing the teeth of the user or the teeth of another human being or animal. The invention comprises a base portion with a plurality of bristles secured in and protruding from the base. A first curved finger gripping device extends from a first side of the base away from the bristles with a second curved finger gripping device extending from a second side of the base away from the bristles. Friction enhancing device are formed in the interior facing surfaces of the first and second finger gripping device.

10 Claims, 2 Drawing Sheets

TOOTHBRUSH

FIELD OF THE INVENTION

This invention relates to a novel finger toothbrush. More particularly, this invention pertains to a unique toothbrush which can fit on a finger of a user for brushing the teeth of the user or the teeth of another human being or animal.

BACKGROUND OF THE INVENTION

Traditional toothbrushes have a head with bristles adjoining a rigid handle which is held by the hand of the user while the user brushes his or her teeth with the bristles. Such toothbrushes have a number of recognized disadvantages including an inability to effectively clean the surfaces of all teeth, particularly those at the rear of the mouth, and a tendency to injure the gums by sharp contacting of the gums by the rigid handle. These conventional toothbrushes are not suitable for use by persons such as arthritics who cannot grip the toothbrush.

In other situations, such as cleaning the teeth of pets, it is more convenient to have the brush mounted on the finger of the person brushing the pets' teeth in order to access tight regions. A finger held toothbrush also permits the user to "feel" the toothbrush and its effects better than in the case where a handle toothbrush is used. Pets have been found by veterinarians and the like to resist a large toothbrush with a handle. However, they do not mind the veterinarian's finger.

Many attempts have been made to design a brush structure to be fixed or held upon the finger of the user. Much greater control and flexibility can be achieved when the brush is manipulated by a finger. However, the known finger brushes have a number of disadvantages. Many prior art finger brushes have a closed end finger sheath which does not adapt well to different finger and fingernail lengths. See e.g., U.S. Pat. No. Des. 97,360 (Stevens).

Another disadvantage of many finger brushes is an inability to retain the brush in proper alignment on the finger during brushing. Prior attempts to overcome this problem include providing: an adhesive strip with overlapping ends, U.S. Pat. Nos. 2,921,590 (Holton) and 2,915,767 (Vaughan); a slit through which the fingertip is inserted, U.S. Pat. No. 2,439,056 (Rathbun); a frustoconical finger holder which may be slit and formed of a resilient material, U.S. Pat. No. 2,396,548 (Allen); a ribbed expandable loop together with a fingernail cavity, U.S. Pat. No. 3,105,260 (Smith et al.); and an elastomeric tubular member of uniform inner dimension which is deformable to snugly (engage the finger, U.S. Pat. No. 4,251,987 (Alam). Many of these devices are undesirable because of their cost and/or they still do not adequately prevent slippage.

Another disadvantage of prior art toothbrushes is that they do not provide an efficient surface for brushing the surfaces of each tooth. Most brushes provide a flat brushing surface which does not effectively contact the contours of the tooth surface. One prior art device, U.S. Pat. No. Des. 97,360 (Stevens), provides an elongated concave brush surface, but this surface would be effective only if aligned vertically with each tooth being brushed. Such positioning is awkward at best, and impossible for teeth in the back of the mouth.

It has also been suggested to shape the brushes of a standard toothbrush to a point to provide a pick for cleaning between the teeth, U.S. Pat. No. 2,155,245 (Sekine). However, this pick has the previously-mentioned disadvantages of brushes on elongated handles and further, no surface is provided for efficiently brushing the surfaces of each tooth.

It has also been suggested to provide a rubber tip on the end of a tongue toothbrush for massaging the gums, and a slit storage compartment and mounting projection for a length of dental floss, U.S. Pat. No. 4,292,705 (Stouffer).

Specifically, U.S. Pat. No. 2,396,548, Allen, discloses a toothbrush comprising an elongated back having parallel side edges, a flat bottom surface and a downwardly concave top surface. Bristles are embedded in the flat surface and extend therefrom. A finger receiving tapered loop is integral with the back overlying the concave surface. The taper of the loop extends along the length thereof. The loop is of substantial length and shorter than the length of the back and has a longitudinally central position with respect to the back. The sides of the loop are downwardly flared adjacent the point of attachment to the back. The longer edges of the flared portions are adjacent the lengthwise edges of the back and have a length substantially equal to the length of the edges.

U.S. Pat. No. 2,915,767, Vaughan, discloses a disposable toothbrush comprising a longitudinally elongated, flexible strip, a resilient pad fixed to one surface of said strip, pressure sensitive adhesive covering at least part of said strip surface not covered by said pad and a plurality of short spaced-apart bristles which are embedded in said pad and which extend through said strip above the surface thereof opposite to said pad forming a small brush which may be fixed upon the finger of a user by wrapping said strip around the finger, and held in place thereon by means of said pressure sensitive adhesive, said resilient pad cooperating with said strip to maintain said bristles in a brushing position during use of the toothbrush.

U.S. Pat. No. 2,921,590, Holton, discloses a disposable tooth cleaning implement comprising, a flexible strip element having bristles projecting from one face thereof. Adhesive flexible tape means laterally extends from the sides of the strip element for adhesive attachment by wrapping to the finger of the user of the implement. The strip means has the outer extremities formed to be free of adhesive to facilitate the stripping of the implement from the finger of the user upon completion of the tooth cleaning operation.

U.S. Pat. No. 3,905,113, Jacob, discloses a dental health tool and method of negating the ability of plaque forming bacteria to build plaque sanctuaries between and around the tooth structure. The tool is a means for securing bristles to the skin surface of a finger of the user in order to permit both the finger nerves and gum tissue nerves to guide the use of the tool.

U.S. Pat. No. 4,617,694, Bori, discloses a finger-mounted device for cleaning teeth having an improved teeth cleaning surface, pick means for cleaning between the teeth, a nonslip finger-engaging means, and means for providing a length of dental floss. The improved teeth cleaning surface consists of a plurality of concave surfaces joined along their raised edges. Each of the concave surfaces is adapted to clean a complimentary shaped convex tooth surface. The raised edges are adapted to clean the tooth edges. The teeth cleaning surface is preferably formed by soft bristles. The pick means comprises a section of hard bristles disposed within the soft bristle area. The distal ends of the hard bristles are tapered to form a point which lies beneath the soft bristle surface. The pick is exposed for cleaning between the teeth by applying a greater pressure than that required for brushing the teeth with the soft bristles. The improved fingerengaging means is a tubular holder having both ends open and including an arcuate portion on end edge defining a concave fingertip surface for engaging the palm side of the fingertip to retain the holder on the finger. A length of dental floss is attached at one end to the device and stored around a spool attached to the device. The opposite end of the floss is attached to ring means which is also mounted on the device but detachable therefrom for unwinding the floss from the spool and holding the floss taut between the ring and device in a teeth flossing position.

SUMMARY OF THE INVENTION

This invention pertains to a finger toothbrush, comprising: a base portion; a plurality of bristles secured in and protruding from the base; a first curved finger gripping means extending from a first side of the base away from the bristles; a second curved finger gripping means extending from a second side of the base away from the bristles; and, friction enhancing means formed in the interior facing surfaces of the first and second finger gripping means.

The friction enhancing means can be splines, grooves or a plurality of discreet protrusions. In the toothbrush, a gap may exist between the two ends of the finger gripping means removed from the base. The friction enhancing means can be splines on both the inside and outside of the finger gripping means. The exterior surfaces of the first and second finger gripping means can have depressions therein.

BRIEF DESCRIPTION OF THE DRAWINGS

In drawings which illustrate specific embodiments of the invention, but which drawings should not be construed as restricting the spirit or scope of the invention in any way.

DETAILED DESCRIPTION OF THE PREFERRED EMBODIMENT

Figure 1:
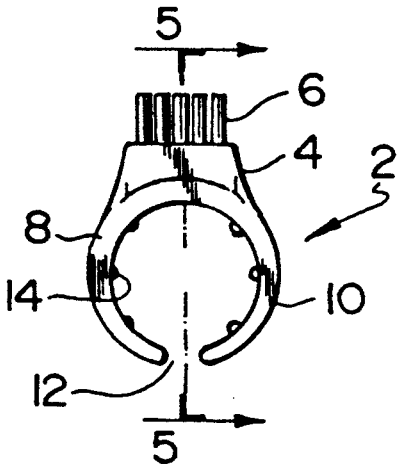
FIG. 1 illustrates an end view of the toothbrush.

Referring to the drawings, FIG. 1 illustrates a front view of the toothbrush 2. The toothbrush is formed of a base 4 which firmly holds the bristles 6, which protrude upwardly from the base 4 in a vertical cluster. The base 4 has protruding downwardly from either side thereof a first finger fitting curved finger grip 8 and a second curved finger grip 10. The first grip 8 and second grip 10 are resilient so that they tend to curve inwardly and downwardly toward one another and grip the user's finger (not shown). There is a gap 12 between the ends of first finger grip 8 and second finger grip 10 opposite the base 4. The bristles 6 are less dense than in an ordinary toothbrush which results in greater softness. This is important in order to prevent gum damage, particularly when brushing the teeth of another human being or animal. The bristles 6 are also shorter in length than in an ordinary toothbrush.

To prevent or deter the curved first and second finger grips 8 and 10 from sliding around the finger, the interior sides of each of first and second finger grips 8 and 10 are equipped with a series of spaced splines 14 which protrude from the interior surfaces of the first and second finger grips 8 and 10 and provide traction on the user's finger. The gap 12 also deters sliding of the ring around the finger because the edges of the first and second finger grips 8 and 10 on each side of the gap 12 dig into the finger.

Figure 3:
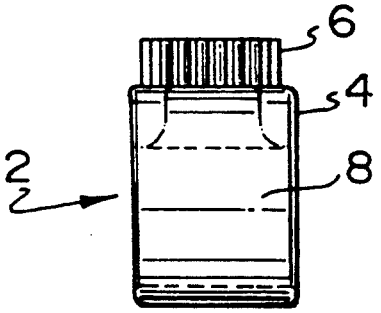
FIG. 3 illustrates a side view of the toothbrush.
Figure 2:
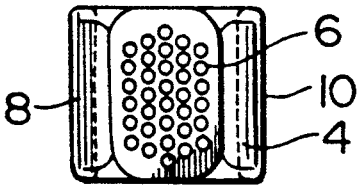
FIG. 2 illustrates a top view of the toothbrush.

FIGS. 2 and 3 illustrate respectively, top and side views of the toothbrush 2. As seen in FIG. 2, the bristles 6 are arranged in a clustered pattern on the base 4. The total number of bristles 6 is about 70 to 80 percent of the number of bristles on a conventional toothbrush with handle. This lower number of bristles provides a softer brushing action. The bristles 6 may be long or short to suit specific needs. As seen in FIG. 3, the crown-shaped base 4 has cut-away corners so that a large clumsy square bristle base 4 is not presented. This design permits the toothbrush 2 to access regions in the mouth of the human being or animal that are normally hard to reach.

Figure 4:
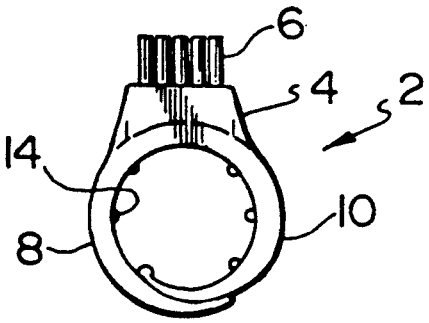
FIG. 4 illustrates an end view of an alternative design of tooth brush.

FIG. 4 illustrates an end view of an alternative embodiment of the toothbrush 2 wherein the ends of the grips 8 and 10 extend to the point where they overlap as shown at point 15.

Figure 5:
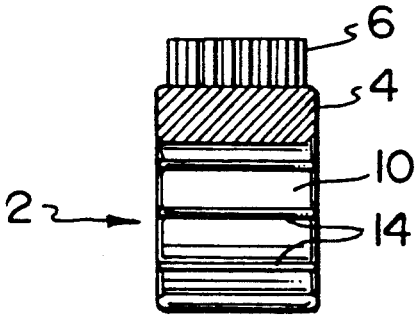
FIG. 5 illustrates a section along section line 5—5 of FIG. 1.
Figure 6:
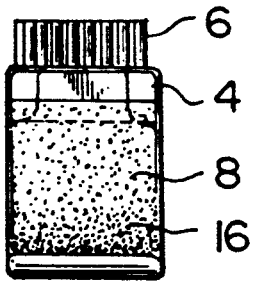
FIG. 6 illustrates an interior section view of an alternative design of finger brush with friction particles embedded in the finger grip.

FIG. 5 shows a section view along section lines 5—5 of FIG. 1. FIG. 5 illustrates the horizontal splines 14 Optionally, in place of the splines 14, or in addition thereto, the grips may have grooves, cross-hatched grooves, or sand or glass beads imbedded in the interior of each of the grips 8 and 10. Any of these enhance the gripability of the first and second finger grips 8 and 10 on the finger.

The finger toothbrush 2 may be injection molded from a suitable plastic such as polyethylene, polypropylene, PVC, or some other suitable resin. Sand or glass particles can be incorporated in the resin as it is injected into the mold thereby providing a grit-like surface to the grips 8 and 10 to enhance finger gripping action. Finger 6 illustrates a section view of the finger brush with particles 16 embedded therein.

Figure 7:
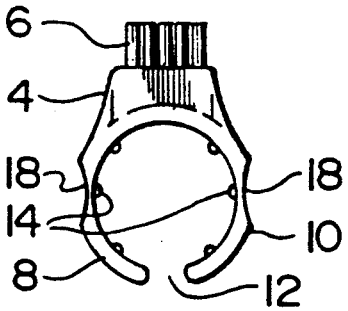
FIG. 7 illustrates a front view of a finger brush design with concave depressions in the exterior of each finger grip.
Figure 8:
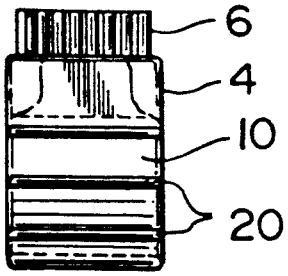
FIG. 8 illustrates a side view of a finger brush design with friction enhancing splines in the exterior surfaces of each finger grip.

Optionally, as seen in FIG. 7, the exterior sides of finger grips 8 and 10 can have concave depressions 18 18 on each side in order to provide locations for the adjacent fingers of the hand to impinge upon. This deters the tendency of the finger toothbrush 2 to slip around the finger. The exterior surfaces of the grips 8 and 10 can also have splines 20, grooves, or a gritty surface to enhance gripping or holding action, as seen in FIG. 8.

Figure 9:
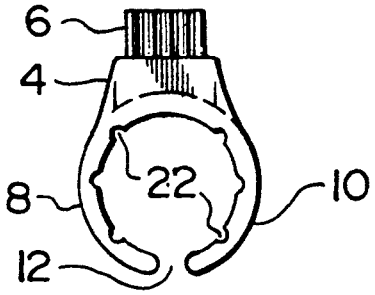
FIG. 9 illustrates a front view of a finger brush design with grooves in the interior surfaces of each finger grip.
Figure 10:
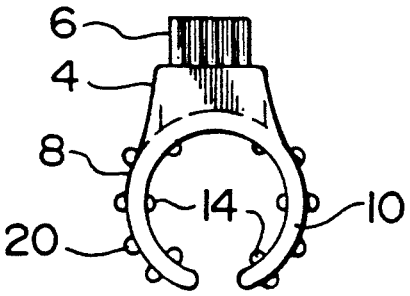
FIG. 10 illustrates a front view of a finger brush design with splines on the exterior and interior surfaces of each finger grip.
Figure 11:
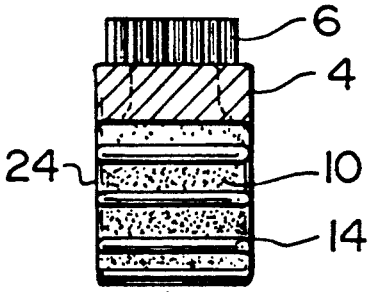
FIG. 11 illustrates a side section view of a finger brush design with splines and friction particles on the interior of the finger grips.

FIG. 9 illustrates a front view of a finger brush design with grooves 22 in the interior surfaces of each finger grip 8 and 10. FIG. 10 illustrates a front view of a finger brush design with splines 20 on the exterior and splines 14 on the interior surfaces of each finger grip 8 and 10. FIG. 11 illustrates a side section view of a finger brush design with splines 14 and friction particles 16 on the interior of the finger grips.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A reusable finger toothbrush, comprising:

(a) a solid base having an exterior face, an interior face and first and second sides opposite to one another;

(b) a plurality of parallel bristles secured in and protruding as a bunch from the exterior face of the base;

(c) a first curved finger gripping means having interior and exterior surfaces, the gripping means extending from the first side of the base in a direction away from the bristles, a distal end of the means curving over the interior face of the base;

(d) a second curved finger gripping means having interior and exterior surfaces, the gripping means extending from the second side of the base in a direction away from the bristles, a distal end of the second means curving over the interior face of the base towards the first finger gripping means, an interior concave surface of the second finger gripping means facing an interior concave surface of the first finger gripping means;

(e) a plurality of friction enhancing twist retarding longitudinal surfaces parallel to a finger-receiving channel defined by the base and the first and second curved finger gripping means and spaced from one another, and formed in and displaced from the respective interior concave facing surfaces of the first and second gripping means; and (f) a plurality of friction enhancing longitudinal surfaces formed on the exterior surfaces of the first and second curved finger gripping means.

2. A toothbrush as claimed in claim 1 wherein at least some of the plurality of friction enhancing longitudinal surfaces are splines.

3. A toothbrush as claimed in claim 1 wherein at least some of the plurality of friction enhancing longitudinal surfaces are grooves.

4. A toothbrush as claimed in claim 1 wherein the plurality of friction enhancing longitudinal surfaces are a plurality of discrete protrusions.

5. A toothbrush as claimed in claim 1 wherein a gap exists between respective distal ends of the finger gripping means removed from the base.

6. A toothbrush as claimed in claim 1 wherein the exterior surfaces of the first and second finger gripping means diametrically opposite from one another have opposite finger grip enhancing curved depressions therein, said depressions defining the plurality of exterior friction enhancing surfaces.

7. A toothbrush as claimed in claim 1 wherein the first and second interior surfaces of the respective first and second gripping means have finger grip enhancing grit-like particles embedded therein.

8. A toothbrush as claimed in claim 1 wherein the distal ends of the first and second gripping means overlap each other.

9. A finger toothbrush, comprising:

(a) a base portion having an exterior face, an interior face and first and second sides opposite to one another;

(b) a plurality of parallel bristles secured in and protruding as a cluster from the exterior face of the base;

(c) a first curved finger gripping means extending from the first side of the base in a direction away from the bristles, a distal end of the gripping means curving over the interior face of the base;

(d) a second curved finger gripping means extending from the second side of the base in a direction away from the bristles, a distal end of the second means curving over the interior face of the base towards the first finger gripping means, an interior concave surface of the second finger gripping means facing an interior concave surface of the first finger gripping means;

(e) a plurality of finger grip enhancing spline means parallel to a finger-receiving channel defined by the base and the first and second curved finger gripping means and spaced from one another formed in the respective interior concave facing surfaces of the first and second finger gripping means; and (f) exterior surfaces of the first and second finger gripping means diametrically opposite from one another having opposite finger grip enhancing concave curved depressions therein.

10. A toothbrush as claimed in claim 9 wherein the first interior surface and the second interior surface of the respective first and second gripping means have finger grip enhancing grit-like particles embedded therein.

* * * * *